United States Patent [19]

Inoue et al.

[11] Patent Number: 4,589,516

[45] Date of Patent: May 20, 1986

[54] MUFFLER FOR INTERNAL COMBUSTION ENGINES

[75] Inventors: Takeshi Inoue; Hiroyuki Saito; Tomoyuki Takewaka; Hiroshi Funabashi, all of Saitama, Japan

[73] Assignee: Honda Giken Kogyo Kabushiki Kaisha, Japan

[21] Appl. No.: 703,368

[22] Filed: Feb. 20, 1985

[30] Foreign Application Priority Data

Feb. 20, 1984 [JP] Japan ..... 59-30868

[51] Int. Cl.[4] ..... F01N 1/24

[52] U.S. Cl. ..... 181/256; 181/272; 181/282

[58] Field of Search ..... 181/224, 243, 245–247, 181/252, 256, 272, 282

[56] References Cited

U.S. PATENT DOCUMENTS

| | | | |
|---|---|---|---|
| 2,834,427 | 5/1958 | Powers et al. | 181/243 |
| 2,933,148 | 4/1960 | Hendry | 181/246 |
| 2,966,226 | 12/1960 | Kalis | 181/243 |
| 3,000,464 | 9/1961 | Watters | 181/224 |
| 3,227,242 | 1/1966 | Mattoon | 181/245 |
| 4,332,307 | 6/1982 | Ito | 181/272 X |
| 4,421,202 | 12/1983 | Hoy | 181/252 |

*Primary Examiner*—Benjamin R. Fuller

*Attorney, Agent, or Firm*—Armstrong, Nikaido, Marmelstein & Kubovcik

[57] ABSTRACT

A muffler for an internal combustion engine includes an outer box composed of a plurality of separate bodies made of a formed sound insulation material and having portions joined by an adhesive, the outer box having an inlet for introducing an exhaust gas from the internal combustion engine and an outlet for discharging the exhaust gas, and a reinforcing member mounted on the joined portions to seal and reinforce the same. The muffler is simple in construction, has a good sound insulation capability, is lightweight, and sufficiently mechanically strong.

4 Claims, 23 Drawing Figures

MUFFLER FOR INTERNAL COMBUSTION ENGINES

BACKGROUND OF THE INVENTION

1. Field of the Invention:

The present invention relates to a muffler for an internal combustion engine, and more particularly to a muffler for use as part of an internal combustion engine.

2. Description of the Prior Art:

Internal combustion engines are generally coupled with silencers or mufflers for expanding and compressing an exhaust gas emitted from the engine to dissipate the energy of the exhaust gas for attenuating the sound produced thereby. The muffler normally comprises an outer box of sheet steel defining therein an expansion chamber. However, the outer box of sheet steel cannot provide sufficient heat and sound insulation, and is relatively heavy. There has been proposed a muffler composed of an outer box of sheet steel and a layer of glass wool applied to the inner wall surface of the outer box. Although the proposed muffler can attain a certain degree of heat and sound insulation, it is complex in construction and also has an increasd weight.

The outer box of a muffler may be constructed of a sound insulation material formed by baking inorganic or organic fibers. Since muffler outer boxes are generally in the form of an elongate tube with front and rear ends closed, it may be advantageous in the manufacturing process to form a plurality of separate bodies of a sound insulation material and then join the formed separate bodies with an adhesive, thereby constructing a muffler outer box.

The muffler outer box is strongly subjected to the influence of heat and pressure variations when in use, and hence is required to have a mechanical strength great enough to withstand these stresses. Where the outer box is composed of the joined separate bodies of formed sound insulation material, the joined portions of the outer box are mechanically weaker than the rest of the outer box.

The present invention has been made in an effort to solve the above conventional problem.

SUMMARY OF THE INVENTION

According to the present invention, a muffler for an internal combustion engine includes an outer box composed of a plurality of separate bodies made of a formed sound insulation material and having portions joined by an adhesive, the outer box having an inlet for introducing an exhaust gas from the internal combustion engine and an outlet for discharging the exhaust gas, and a reinforcing member mounted on the joined portions to seal and reinforce the same.

Accordingly, it is an object of the present invention to provide a muffler for internal combustion engines which is simple in construction, has a good sound insulation capability, is lightweight, and sufficiently mechanically strong.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
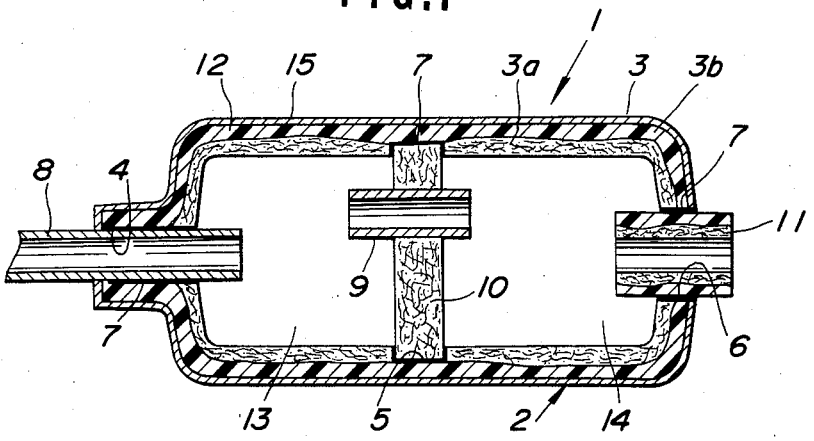
FIG. 1 is a longitudinal cross-sectional view of a muffler according to a first embodiment of the present invention.
Figure 2:
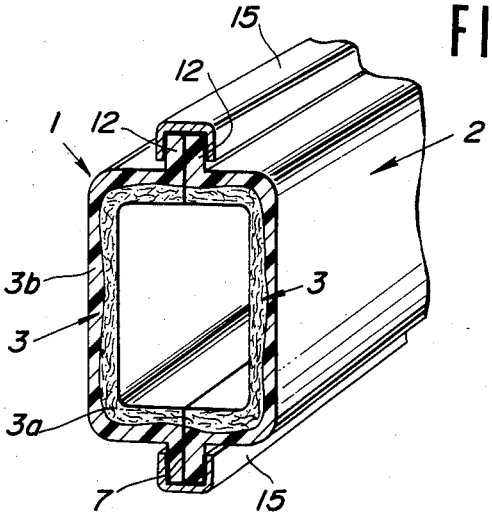
FIG. 2 is a fragmentary perspective view, partly in a radial or transverse cross section, of the muffler shown in FIG. 1.

FIGS. 1 and 2 show a muffler in accordance with a first embodiment of the present invention, the muffler being generally designated by the reference numeral 1. The muffler 1 has a tubular outer box 2 having front and rear ends closed and composed of a pair of lateral separate bodies 3, 3 of a formed sound insulation material. The formed sound insulation material constituting each of the separate bodies 3, 3 has an inner porous layer 3*a* and an outer tight layer 3*b*.

Each of the separate bodies 3 is formed as follows:

Inorganic or organic fibers such as long glass fibers, ceramic fibers, or the like are cut off and mixed together into wad, which is then pressed by rolls and needled into a mat. Thereafter, the mat is impregnated with a binder such as water glass. The fibrous mat is coated, on its surface serving as an outer surface of a separate body, with a solution of a thermosetting resin such as phenolic resin, epoxy resin, polyester, or the like. The mat is then placed in a mold of a given shape and baked. The coated solution of thermosetting resin is hardened into the tight layer 3*b* with the other portion serving as the porous layer 3*a*, thus forming the separate body 3 which is open at one side.

The separate body 3 has recesses 4, 5, 6 respectively in front end, intermediate, and rear end portions thereof.

For assembling the separate bodies 3, 3 into the muffler 1, the inner surfaces of the recesses 4, 5, 6 in one of the separate bodies 3 are coated with a thermally resistant adhesive 7, for example. An exhaust pipe 8 is fitted in the recess 4, a separator 10 with a connector pipe 9 supported thereby is fitted in the recess 5, and a tail pipe 11 is fitted in the recess 6. The inner surfaces of the recesses 4, 5, 6 in the companion separate body 3 are also coated with the adhesive 7. The adhesive 7 is also coated on the inner surfaces of outwardly projecting flanges 12 of the separate bodies 3, 3. The separate bodies 3, 3 are then joined together with the flanges 12, 12 held in abutment against each other. The bonded separate bodies 3, 3 now form the tubular outer box 2. The exhaust pipe 8 is inserted through and held by the front end portion of the outer box 2, the interior of which is divided by the separator 10 into a first expansion chamber 13 and a second expansion chamber 14. The tail pipe 11 is inserted through and held by the rear end of the outer box 2. Each of the connector pipe 9, the separator 10, and the tail pipe 11 is constructed of the same formed sound insulation material as that which the separate bodies 3, 3 are made of.

After the outer box 2 has been assembled, reinforcing members 15 are mounted by the adhesive 7 on outer surfaces of the flanges 12, 12 of the separate bodies 3, 3. Each of the reinforcing members 15 is formed of a resin or sheet steel and has a channel-shaped cross section gripping the flanges 12, 12 laterally together.

With the above embodiment, the outer box 2 of the muffler 1 is constructed of the joined separate bodies 3, 3 of a formed sound insulation material, and the connector pipe 9, the separator 10, the tail pipe 11 are also made of the same formed sound insulation material. Therefore, the muffler 1 is greatly reduced in weight and has an increased sound insulation capability. Since the reinforcing members 15 are mounted on the joined portions or flanges 12, the areas joined by the adhesive 7 are large, making the overall muffler 1 more rigid and and well sealed.

Figure 3:
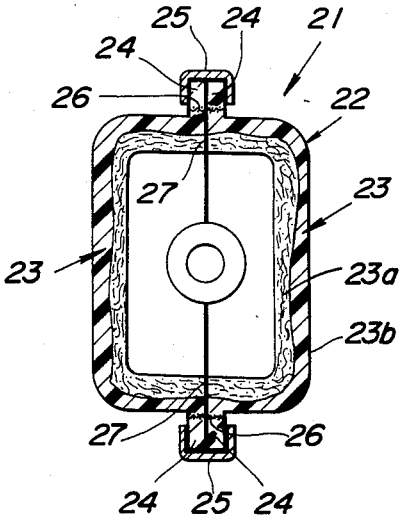
FIG. 3 is a transverse cross-sectional view of a muffler according to a second embodiment of the present invention.

FIG. 3 shows a muffler 21 according to a second embodiment of the invention. The muffler 21 has an outer box 22 composed of separate bodies 23, 23 each made of a formed sound insulation material and composed of an inner porous layer 23*a* and an outer tight layer 23*b*. The separate bodies 23, 23 have flanges 24, 24 joined together by an adhesive 27 and covered on their outer surfaces with reinforcing members 25. The flanges 24, 24 are stitched with fibers 26 for increased bonding strength and sealing capability.

Figure 4:
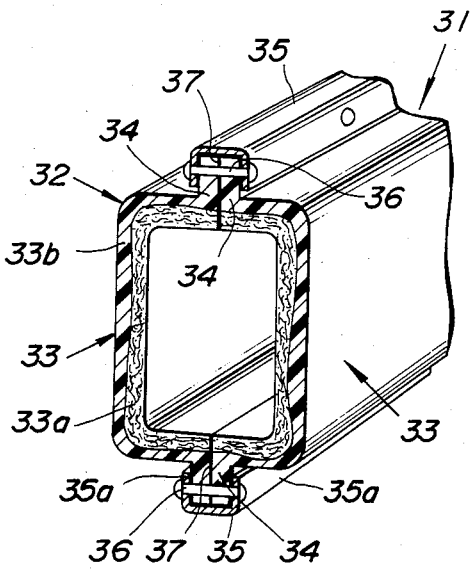
FIG. 4 is a view similar to FIG. 2, showing a muffler according to a third embodiment of the present invention.

FIG. 4 illustrates a muffler 31 according to a third embodiment of the invention. The muffler 31 has an outer box 32 composed of separate bodies 33, 33 each made of a formed sound insulation material and composed of an inner porous layer 33*a* and an outer tight layer 33*b*. The separate bodies 33, 33 have flanges 34, 34 joined together by an adhesive 37 and gripped by reinforcing members 35 each having a channel-shaped cross section. Each of the reinforcing members 35 has a pair of spaced legs 35*a*, 35*a* connected together by rivets 36 extending therethrough for higher bonding strength and sealing capability.

Figure 6:
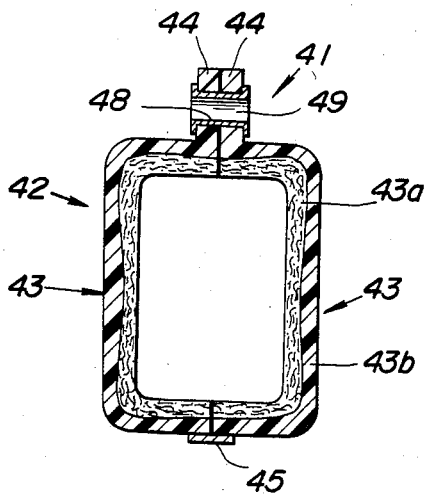
FIG. 6 is a cross-sectional view taken along line 6—6 of FIG. 5.
Figure 5:
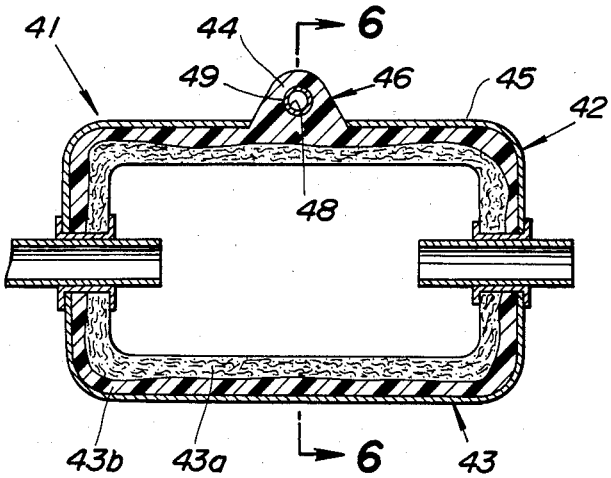
FIG. 5 is a longitudinal cross-sectional view of a muffler according to a fourth embodiment of the present invention.

A muffler 41 according to a fourth embodiment is illustrated in FIGS. 5 and 6. The muffler 41 has an outer box 42 comprising a pair of separate bodies 43, 43 each composed of an inner porous layer 43*a* and an outer tight layer 43*b*, the separate bodies 43, 43 having respective integral flanges or lugs 44, 44 projecting from upper central portions thereof. The separate bodies 43, 43 are joined together by an adhesive 47, with the lugs 44, 44 serving as a hanger stay 46. The hanger stay 46 has a bolt attachment hole 48 in which a damping rubber tube 49 is fitted. A web-shaped reinforcing member 45 is bonded to outer surfaces of the joined portions of the separate bodies 43, 43. The muffler 41 thus has an attachment, or the hanger stay 46, of an increased mechanical strength.

Figure 7:
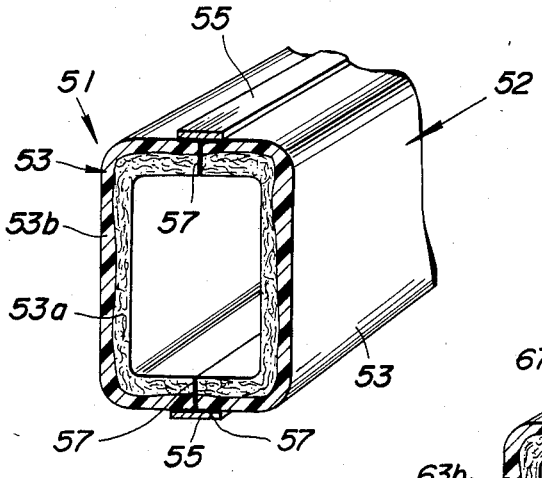
FIG. 7 is a view similar to FIG. 2, showing a muffler according to a fifth embodiment of the present invention.

According to a fifth embodiment shown in FIG. 7, a muffler 51 has an outer box 52 composed of separate bodies 53, 53 bonded by an adhesive 57 and each comprising an inner porous layer 53*a* and an outer tight layer 53*b*. A web-shaped reinforcing member 55 is bonded by the adhesive 57 to outer surfaces of the joined portions of the separate bodies 53, 53.

Figure 8:
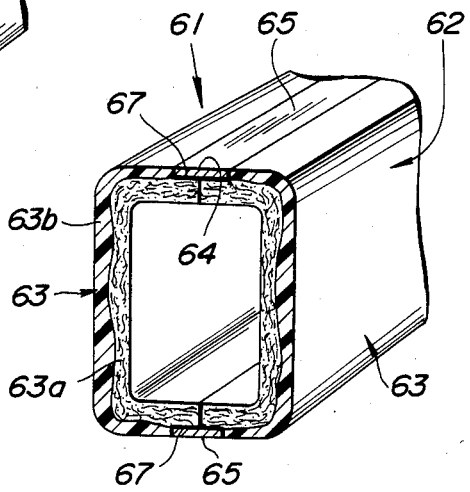
FIG. 8 is a view similar to FIG. 2, showing a muffler according to a sixth embodiment of the present invention.

FIG. 8 shows a sixth embodiment in which a muffler 61 has bonded separate bodies 63, 63, and tight layers 63*b* thereof have an elongate recess 64 of a prescribed width defined by cutting off abutting portions of the separate bodies 63, 63. A web-shaped reinforcing member 65 is fitted and bonded in the recess 64 by an adhesive 67. The reinforcing member 65 has an outer surface lying flush with an outer surface of the outer box 62. The muffler 61 thus constructed provides a sightly appearance as well as increased rigidity.

Figure 9:
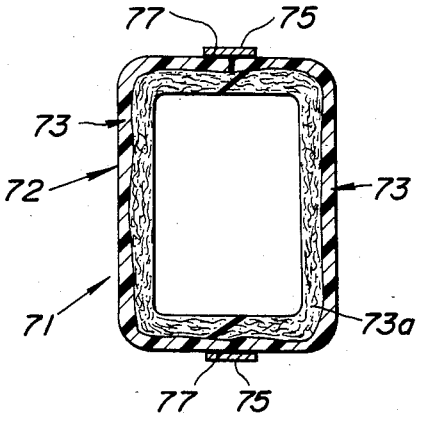
FIG. 9 is a view similar to FIG. 3, showing a muffler according to a seventh embodiment of the present invention.

FIG. 9 is illustrative of a muffler 71 according to a seventh embodiment of the invention. The muffler 71 comprises an outer box 72 composed of a pair of bonded separate bodies 73, 73 with an web-shaped reinforcing member 75 bonded by an adhesive 77 to outer surfaces of the joined portions of the separate bodies 73, 73 for increased rigidity and sealing capability. In addition, inner porous layers 73*a*, 73*a* of the separate bodies 73, 73 have slanted abutting surfaces joined together in overlapping relation for effective thermal insulation.

Figure 10:
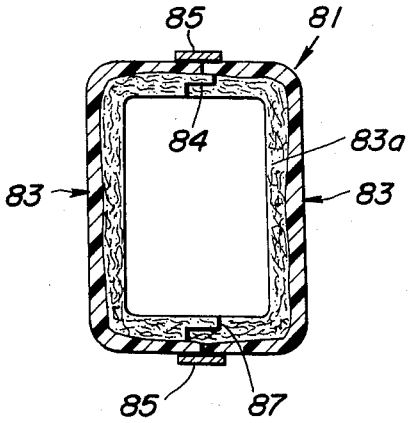
FIG. 10 is a view similar to FIG. 3, showing a muffler according to an eighth embodiment of the present invention.

As shown in FIG. 10, a muffler 81 according to an eighth embodiment comprises separate bodies 83, 83 including porous layers 83*a*, 83*a* having stepped abutting portions 84 joined in complementarily meshing relation by an adhesive 87. A web-shaped reinforcing member 85 is attached to outer surfaces of the joined portions of the separate bodies 83, 83. The muffler 81 of FIG. 10 provides increased rigidity and effective thermal insulation.

Figure 11:
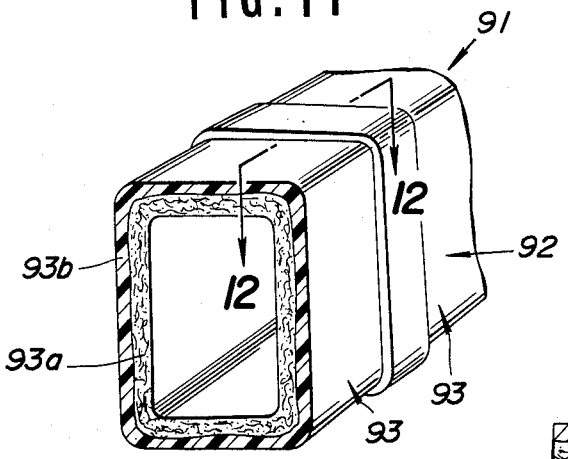
FIG. 11 is a view similar to FIG. 2, showing a muffler according to a ninth embodiment of the present invention.
Figure 12:
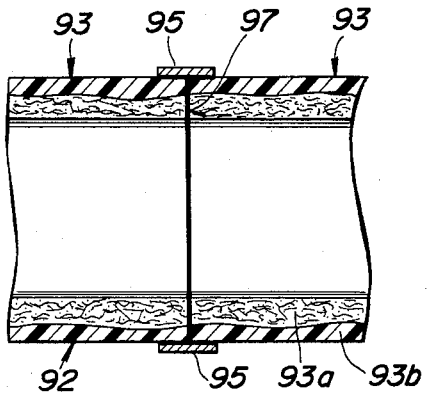
FIG. 12 is a cross-sectional view taken along line 12—12 of FIG. 11.

FIGS. 11 and 12 illustrate a muffler 91 according to a ninth embodiment of the invention. While in each of the previous embodiments the outer box is composed of transversely separate bodies, divided by a plane lying along the axis of the outer box, the muffler 91 of the ninth embodiment comprises an outer box 92 composed of tubular longitudinally separate bodies 93, 93, divided by a plane lying perpendicularly to the axis of the outer box. Each of the separate bodies 93, 93 includes an inner porous layer 93*a* and an outer tight layer 93*b*. A front end of one of the separate bodies 93 is joined by an adhesive 97 to a rear end of the other separate body 93, and an annular reinforcing member 95 is disposed around outer surfaces of the joined portions.

Figure 13:
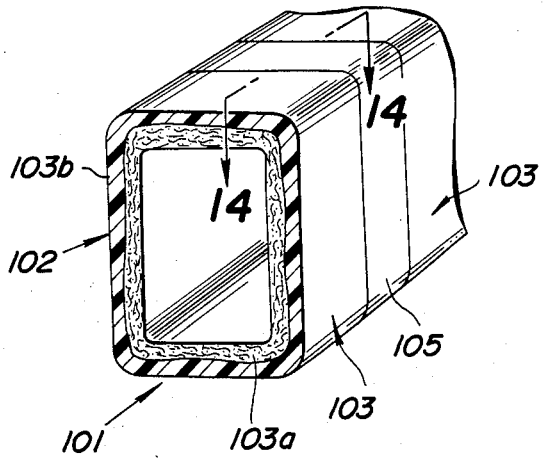
FIG. 13 a view similar to FIG. 2, showing a muffler according to a tenth embodiment of the present invention.
Figure 14:
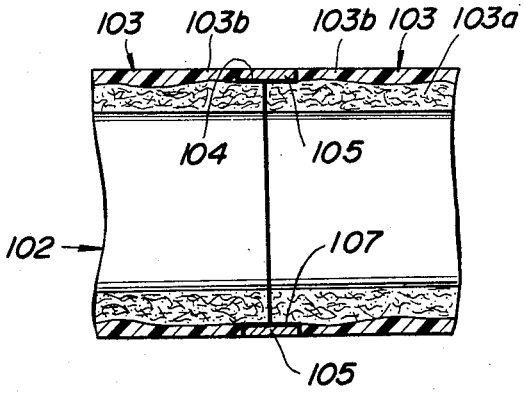
FIG. 14 is a cross-sectional view taken along line 14—14 of FIG. 13.

According to a tenth embodiment illustrated in FIGS. 13 and 14, a muffler 101 has an outer box 102 composed of longitudinally separate bodies 103, 103. The outer box 102 has an annular recess 104 defined by cutting off a rear circumferential edge portion of an outer tight layer 103*b* of one of the separate bodies 103 and a front circumferential edge portion of an outer tight layer 103*b* of the other separate body 103. An annular reinforcing member 105 is fitted in the annular recess 104 and bonded by an adhesive 107 to the separate bodies 103, 103. The reinforcing member 105 and the outer box 102 have outer surfaces lying flush with each other. The muffler 101 has larger bonding areas for increased mechanical strength and sealing capability, and also a sightly appearance.

Figure 15:
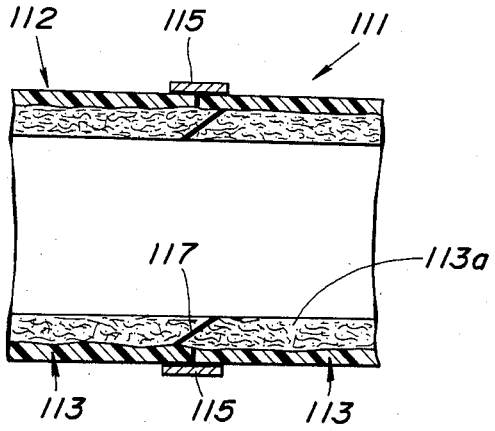
FIG. 15 is a view similar to FIG. 1, illustrating a muffler according to an eleventh embodiment of the invention.

FIG. 15 shows a muffler 111 constructed in accordance with an eleventh embodiment of the invention. The muffler 111 includes an outer box 112 comprising a pair of longitudinally separate bodies 113, 113 bonded together by an adhesive 117 partly at slanted and overlapped surfaces of inner porous layers 113*a*, the joined portions being sealed by an annular reinforcing member 115 disposed around the outer box 112.

Figure 16:
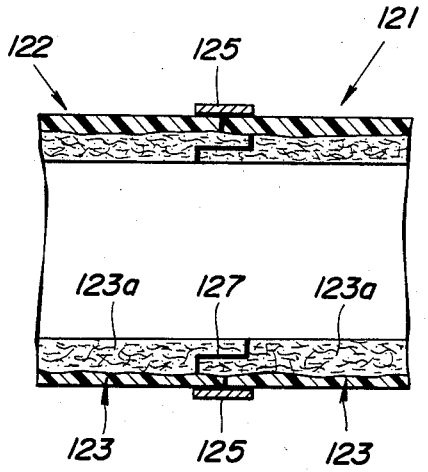
FIG. 16 is a view similar to FIG. 1, illustrating a muffler according to a twelfth embodiment of the invention.

According to a twelfth embodiment shown in FIG. 16, a muffler 121 has an outer box 122 composed of a pair of longitudinally separate tubular bodies 123, 123 including respective porous layers 123*a*, 123*a* having stepped portions overlapped and bonded together by an adhesive 127. The joined portion are surrounded by an annular reinforcing member 125. With the tubular separate bodies partially overlapped, rhe mechanical strength and thermal insulation of the muffler 121 are increased.

Figure 17:
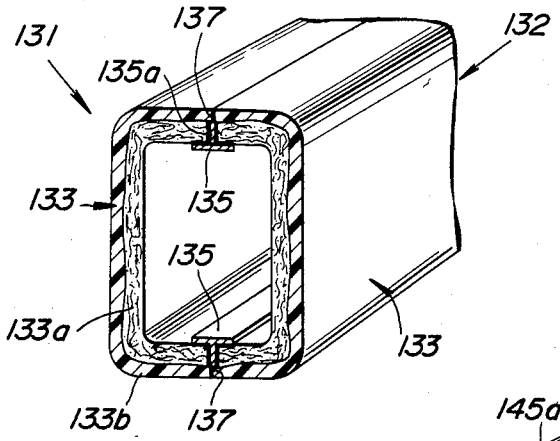
FIG. 17 is a view similar to FIG. 2, illustrating a muffler according to a thirteenth embodiment of the present invention.

As shown in FIG. 17, a muffler 131 according to a thirteenth embodiment of the invention has an outer box 132 composed of two transversely separate bodies 133, 133, open at one side, joined together by an adhesive 137. Each of the separate bodies 133, 133 is made of a formed sound insulation material and composed of an inner porous layer 133*a* and an outer porous layer 133*b*. There are small clearance gaps defined between confronting ends of the porous layers 133*a*, 133*a* of the separate bodies 133, 133. A reinforcing member 135 of a T-shaped cross section is disposed within the outer box 132 and has a leg 135*a* inserted in each of the clearance gaps. The porous layers 133*a*, 133*a*, and the reinforcing member 135 are bonded together by the adhesive 137. With this construction, the muffler 131 is sightly since the reinforcing member 135 is not exposed to view.

Figure 18:
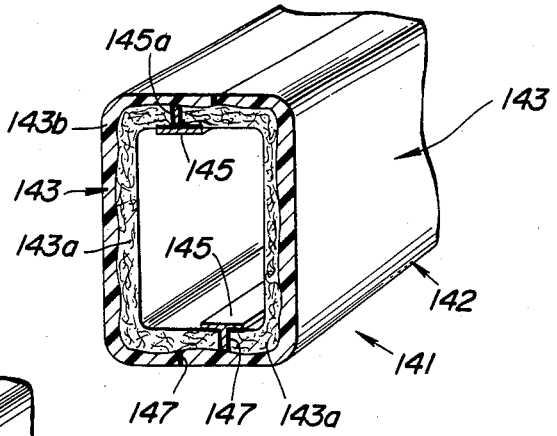
FIG. 18 is a view similar to FIG. 2, showing a muffler according to a fourteenth embodiment of the present invention.

FIG. 18 illustrates a muffler 141 according to a fourteenth embodiment of the invention. The muffler 141 has an outer box 142 composed of separate bodies 143, 143 including porous layers 143*a*, 143*a* and tight layers 143*b*, 143*b* which have joined portions positionally displaced transversely from each other and also from a central axis of the outer box 142. Between the porous layers 143*a*, 143*a*, there are defined clearance gaps in which legs 145*a* of cross-sectionally T-shaped reinforcing members 145 are inserted and bonded by an adhesive 147. The staggered arrangement of the joined surfaces of the porous layers 143*a*, 143*a* and the joined surfaces of the tight layers 143*b*, 143*b* is effective in increasing the sealing capability and rigidity.

Figure 19:
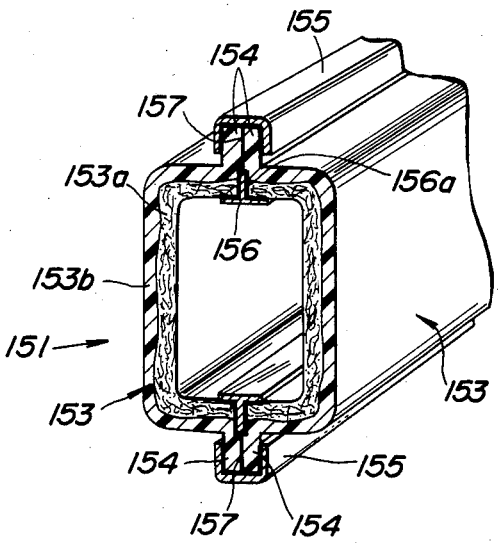
FIG. 19 is a view similar to FIG. 2, showing a muffler according to a fifteenth embodiment of the present invention.

A muffler 151 according to a fifteenth embodiment of the invention is shown in FIG. 19. The muffler 151 comprises a pair of separate bodies 153, 153 of a formed sound insulation material, each composed of an inner porous layer 153*a* and an outer tight layer 153*b*. The separate bodies 153, 153 have two pairs of integral flanges 154, 154 with inner surfaces thereof held against and bonded to each other by an adhesive 157. The abutting flanges 154, 154 in each pair are covered with a channel-shaped reinforcing member 155 disposed on outer surfaces thereof. A reinforcing member 156 of a T-shaped cross section is disposed within the muffler 151 and has a leg 156*a* inserted through the inner porous layers 153*a* up to a point between the flanges 154, 154, the leg 156*a* being bonded to the flanges 154, 154.

The mechanical strength of the muffler 151 is thus increased by the reinforcing members 155, 156 disposed on outer and inner surfaces of the flanges 154, 154.

Figure 20:
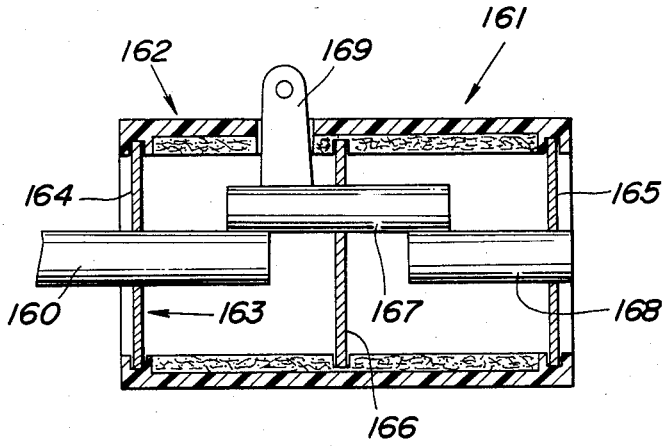
FIG. 20 is a longitudinal cross-sectional view of a muffler according to a sixteenth embodiment of the invention.
Figure 21:
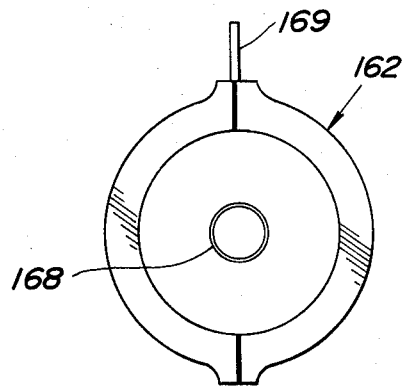
FIG. 21 is an end elevational view of the muffler shown in FIG. 20.

FIGS. 20 and 21 show a muffler 161 according to a sixteenth embodiment of the invention. The muffler 161 has an outer box 162 supported by an inner structural member 163 of an iron-based material. Ihe inner structural member 163 is composed of a front end plate 164, a rear end plate 165, a separator 166, a connector pipe 167, and a tail pipe 168. The inner structural member 163 is integrally connected to an attachment stay 169 and an exhaust pipe 160.

Figure 22:
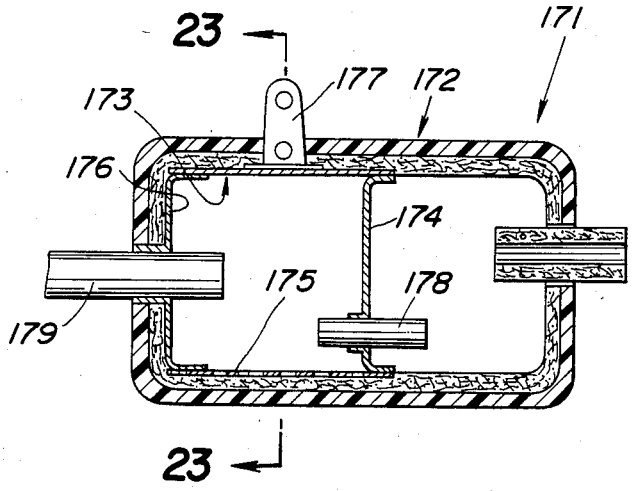
FIG. 22 is a longitudinal cross-sectional view of a muffler according to a seventeenth embodiment of the invention.
Figure 23:
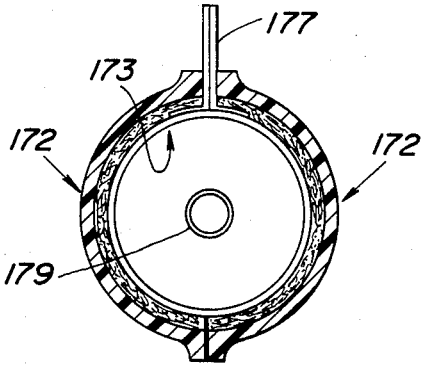
FIG. 23 is a cross-sectional view taken along line 23—23 of FIG. 22.

According to a seventeenth embodiment illustrated in FIGS. 22 and 23, a muffler 171 includes an outer box 172 supported by an inner structural member 163 of an iron-based material. The inner structural member 163 comprises a separator 174, a punched plate 175, and a front end plate 176, and is integrally coupled to an attachment stay 177, a connector pipe 178, and an exhaust pipe 179.

With the sixteenth and seventeenth embodiments, the outer box is highly resistant to undue stresses because it is supported and stiffened by the inner structural member.

The present invention has been described by way of example only. The reinforcing members are not limited to the shapes and materials referred to above. The outer layer of the sound insulation material has been described as the tight layer which is formed of a thermosetting resin. However, the tight layer may be dispensed with, and the separate body may be composed solely of the porous layer.

With the arrangement of the present invention, the muffler is lightweight and has excellent sound insulation characteristics since the outer box of the muffler is constructed of a formed sound insulation material. As the outer box is composed of joined separate bodies of the formed sound insulation material, the outer box can easily be assembled. With the reinforcing members disposed on hte joined portions, the joined areas are widened to increase the mechanical strength and sealing capability of the joined portions. Better sound insulation can be provided by constructing the formed sound insulation material to have an outer tight layer.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

What is claimed is:

1. A muffler for an internal combustion engine comprising:

(a) an outer box composed of separated bodies made of a formed sound insulation material and having portions joined by an adhesive, said outer box having an inlet for introducing an exhaust gas from the internal combustion engine and an outlet for discharging the exhaust gas;

(b) a reinforcing member mounted on said joined portions to seal and reinforce the same;

(c) an inner structural member of an iron-based material disposed in said outer box and supporting said outer box;

(d) an exhaust pipe connected to said internal combustion engine and to said inlet;

(e) an attachment stay mounted on said outer box; and (f) said inner structural member being connected to said attachment stay and to the exhaust pipe.

2. A muffler according to claim 1, wherein said inner structural member comprises a front end plate, a rear end plate, and a separator which are connected to said outer box in longitudinally spaced relation, a connector pipe mounted on said separator, and a tail pipe mounted on said rear end plate, said exhaust pipe being supported by said front end plate.

3. A muffler for an internal combustion engine comprising:

(a) an outer box composed of a plurality of separate bodies made of a formed sound insulation material and having portions joined by an adhesive, said outer box having an inlet for introducing an exhaust gas from the internal combustion engine and an outlet for discharging the exhaust gas;

(b) a reinforcing web member mounted on said joined portions to seal and reinforce the same;

(c) said formed sound insulation material including an inner porous layer an outer tight layer;

(d) said separate bodies having respective integral lugs projecting from upper portions of said bodies to form a hanger stay; and (e) a damping bushing extending transversely through an aperture in said lugs.

4. A muffler as claimed in claim 3, wherein said reinforcement web is recessed in said outer periphery of said bodies.

* * * * *